US006305277B1

(12) United States Patent
Witczak et al.

(10) Patent No.: US 6,305,277 B1
(45) Date of Patent: Oct. 23, 2001

(54) COIL HANDLING DEVICE

(75) Inventors: Stanislaw Witczak, Norwood Park Township, IL (US); Bobby L. Goin, Florence, SC (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/383,446

(22) Filed: Aug. 26, 1999

(51) Int. Cl.[7] ..... B65B 27/06

(52) U.S. Cl. ..... 100/2; 100/12; 100/14; 414/684; 414/816

(58) Field of Search ..... 100/2, 3, 5, 7, 100/12, 14, 25, 26, 916; 53/399, 409, 204, 589; 414/684, 784, 816

(56) References Cited

U.S. PATENT DOCUMENTS

| | | | | |
|---|---|---|---|---|
| 2,336,614 | * | 12/1943 | Jackson | 100/12 |
| 2,700,332 | * | 1/1955 | Donald | 100/2 |
| 2,780,985 | * | 2/1957 | Laine | 100/14 |
| 2,926,598 | * | 3/1960 | Dentzer et al. | 100/12 |
| 3,400,652 | * | 9/1968 | Hill et al. | 100/12 |
| 3,788,210 | * | 1/1974 | Lingemann | 100/12 |

FOREIGN PATENT DOCUMENTS

| | | | | |
|---|---|---|---|---|
| 2153093 | * | 5/1973 | (DE) | 100/12 |
| 1072592 | * | 6/1967 | (GB) | 100/12 |

* cited by examiner

*Primary Examiner*—Stephen F. Gerrity
(74) *Attorney, Agent, or Firm*—Schwartz & Weinrieb

(57) ABSTRACT

A coil handling system, and a method of operating the same, comprises an indexer assembly having a pair of rotatable spindles mounted thereon for supporting a coil of material upon which binding straps are to be placed at predetermined circumferential positions by a strap binding assembly when the rotatable spindles index the coil of material to the predetermined circumferential positions. Upon completion of the strap binding operation, an upender assembly is moved upwardly from a lowered position so as to remove the bound coil of material from the indexer assembly, the indexer assembly is moved to a location remote from the upender assembly so as to permit the upender assembly to be returned to its lowered position with the bound coil of material supported thereon, and the upender assembly is returned to its lowered position at which the upender assembly deposits the bound coil of material upon a conveyor assembly which conveys the bound coil of material to a remote location for further routing or processing prior to commercial distribution.

20 Claims, 11 Drawing Sheets

COIL HANDLING DEVICE

FIELD OF THE INVENTION

The present invention relates generally to strap coil handling apparatus, and more particularly to automatic apparatus for handling strap coils wherein the apparatus includes spindles which support the strap coil during an indexing and strap binding operation by means of which binding straps are placed upon predetermined circumferential positions of the coil, and wherein further, the apparatus automatically removes the bound strap coil from the spindles upon completion of the strap binding operation and places the bound strap coil upon a conveyor mechanism which transports the bound strap coil to a remote location for further routing or processing prior to ultimate commercial distribution.

BACKGROUND OF THE INVENTION

Machinery, apparatus, and equipment conventionally exist wherein, for example, multiple stands are provided such that plastic strapping or the like is automatically coiled upon a suitable core or mandrel, such as, for example, a hard cardboard reel. Upon completion of the strap coiling operation, each strap coil must necessarily be removed from the strap coiling machinery or equipment, and binding straps must then be placed around the strap coil at predetermined circumferential locations thereof so as to preserve the coiled integrity of the strap coil whereby the coil is effectively prevented from either circumferentially uncoiling or axially telescoping.

The strap binding operation is performed by an operator who must therefore remove a completed strap coil from a particular one of the multiple strap coiling stands, carry the completed strap coil to the strap binding stand, and place the strap coil upon the strap binding stand. Using a manual, hand-held strap tensioning and binding tool, and after manually placing a cardboard edge protector around the strap coil at a particular circumferential location thereof, the operator then uses the manual, hand-held strap tensioning and binding tool to tension, weld, and cut the binding strap. Subsequently, the strap coil is rotated so as to effectively circumferentially index the strap coil to a new circumferential position at which another binding strap is to be applied to the strap coil. Upon completion of the strap binding operation, the operator manually removes the bound strap coil from the strap binding stand and places the bound strap coil upon a pallet which may then be subsequently transported, for example, by suitable fork-lift apparatus for further processing prior to commercial distribution.

It is thus readily appreciated that the entire strap coiling and binding operation is quite labor-intensive, tedious, and fatiguing for the operator personnel. Accordingly, a need exists in the art for the development of automatic machinery, apparatus, or equipment which can automatically perform the various manual operations which were necessarily previously performed by strap coiling and strap binding operator personnel.

OBJECTS OF THE INVENTION

Accordingly, it is an object of the present invention to provide new and improved strap coil apparatus, equipment, or machinery comprising a coil handling device which automatically applies binding straps to a strap coil and which automatically places the bound strap coil upon a discharge conveyor.

Another object of the present invention is to provide new and improved strap coil apparatus, equipment, or machinery comprising a coil handling device which overcomes the various drawbacks and disadvantages characteristic of conventional strap coil handling apparatus and techniques.

An additional object of the present invention is to provide new and improved strap coil apparatus, equipment, or machinery comprising a coil handling device which is extremely easy to use by operator personnel wherein the laborintensive, tedious, and fatiguing characteristics of conventional strap coil binding operations is effectively eliminated or at least drastically reduced.

SUMMARY OF THE INVENTION

The foregoing and other objectives are achieved in accordance with the teachings and principles of the present invention through the provision of new and improved strap coil apparatus, equipment, or machinery comprising a coil handling device which includes a main framework upon which there is mounted an indexing mechanism which comprises a pair of rotatable spindles for supporting a strap coil. The spindles are mounted upon a framework which is pivotally mounted upon the main framework so as to be movable between an upwardly retracted inoperative position and a lowered extended operative position at which the spindles support the strap coil. A binding strap head assembly is movable between a retracted inoperative position and an extended operative position at which the binding strap head cooperates with the indexing mechanism so as to place binding straps at predetermined circumferential positions of the strap coil.

When the strap binding operation is completed, the binding strap head is moved or returned to its retracted inoperative position whereupon an upender mechanism is pivoted upwardly so as to engage the bound strap coil and elevate the same so as to effectively remove the bound strap coil from the spindles of the indexing mechanism. The spindles of the indexing mechanism are then able to be moved to their upward inoperative position whereupon the upender mechanism, which now supports the bound strap coil, is pivoted downwardly so as place the bound strap coil upon a suitable conveyor mechanism which transports the bound strap coil to a remote location for further routing or processing prior to commercial distribution. Subsequently, the indexing mechanism spindles are pivotally lowered back to their operative position in preparation for receiving a new strap coil whereby another operative cycle of the apparatus can be performed.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
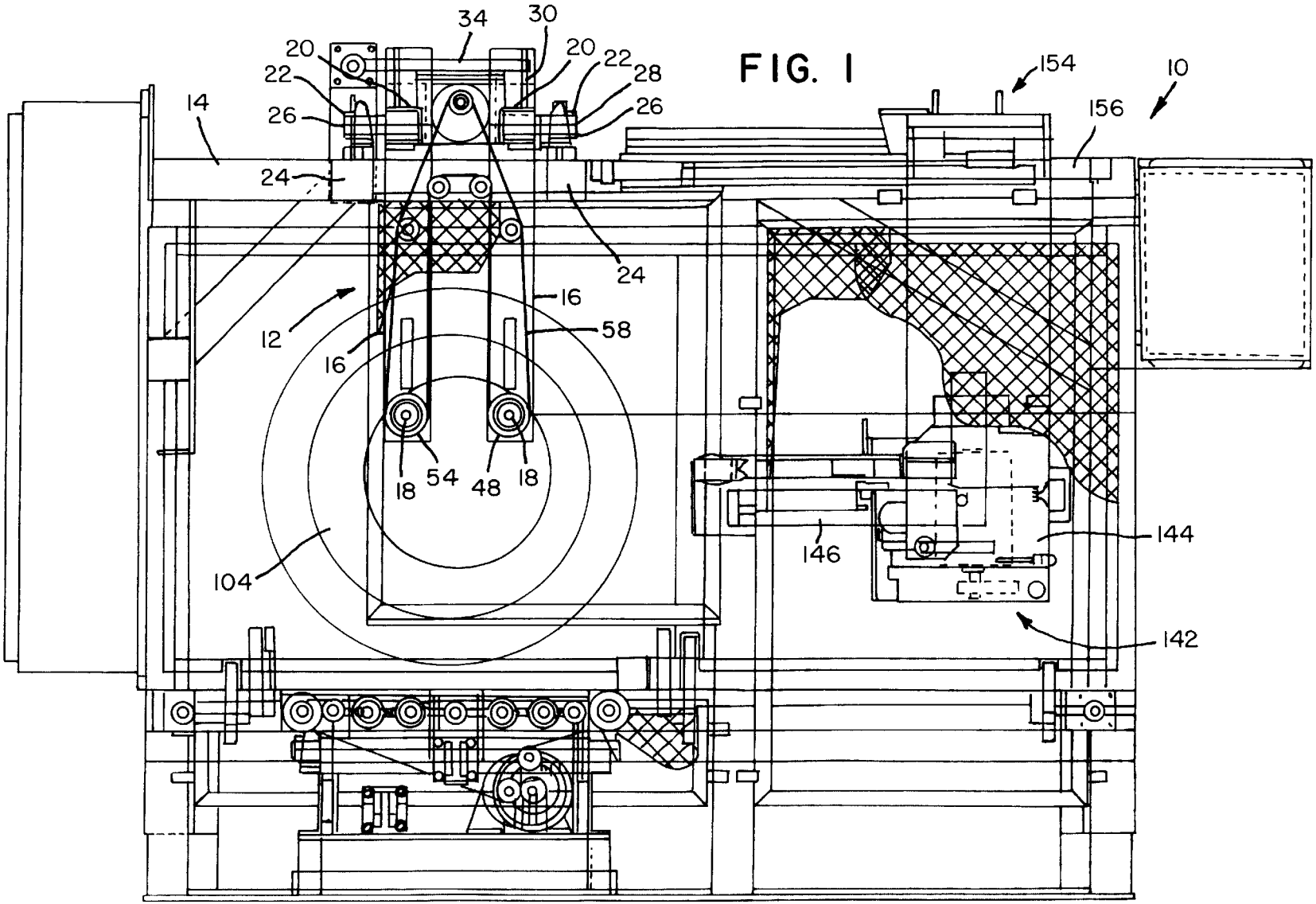
FIG. 1 is a front elevational view of the new and improved coil handling apparatus constructed in accordance with the principles and teachings of the present invention.
Figure 2:
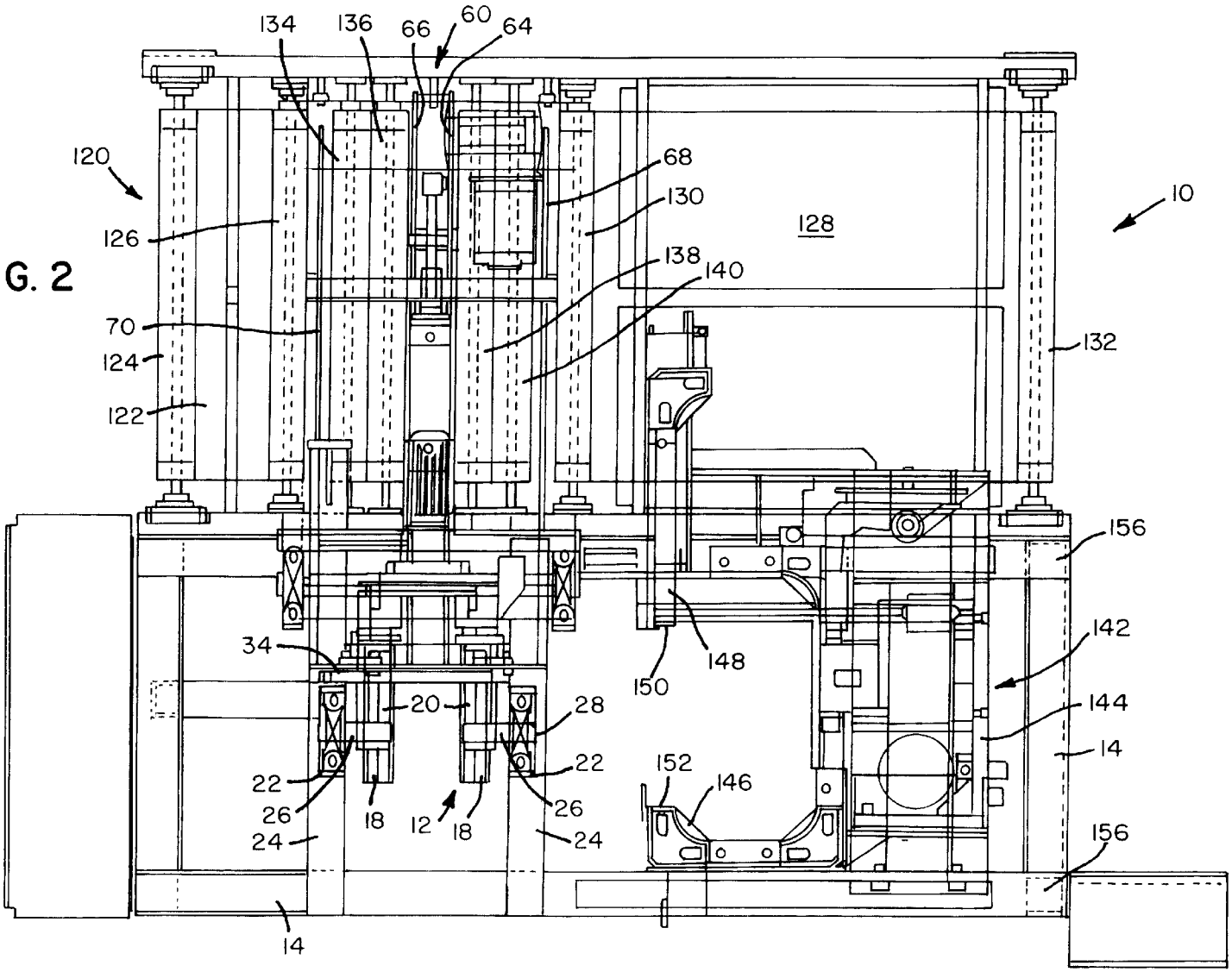
FIG. 2 is a top plan view of the new and improved coil handling apparatus shown in FIG. 1.
Figure 3:
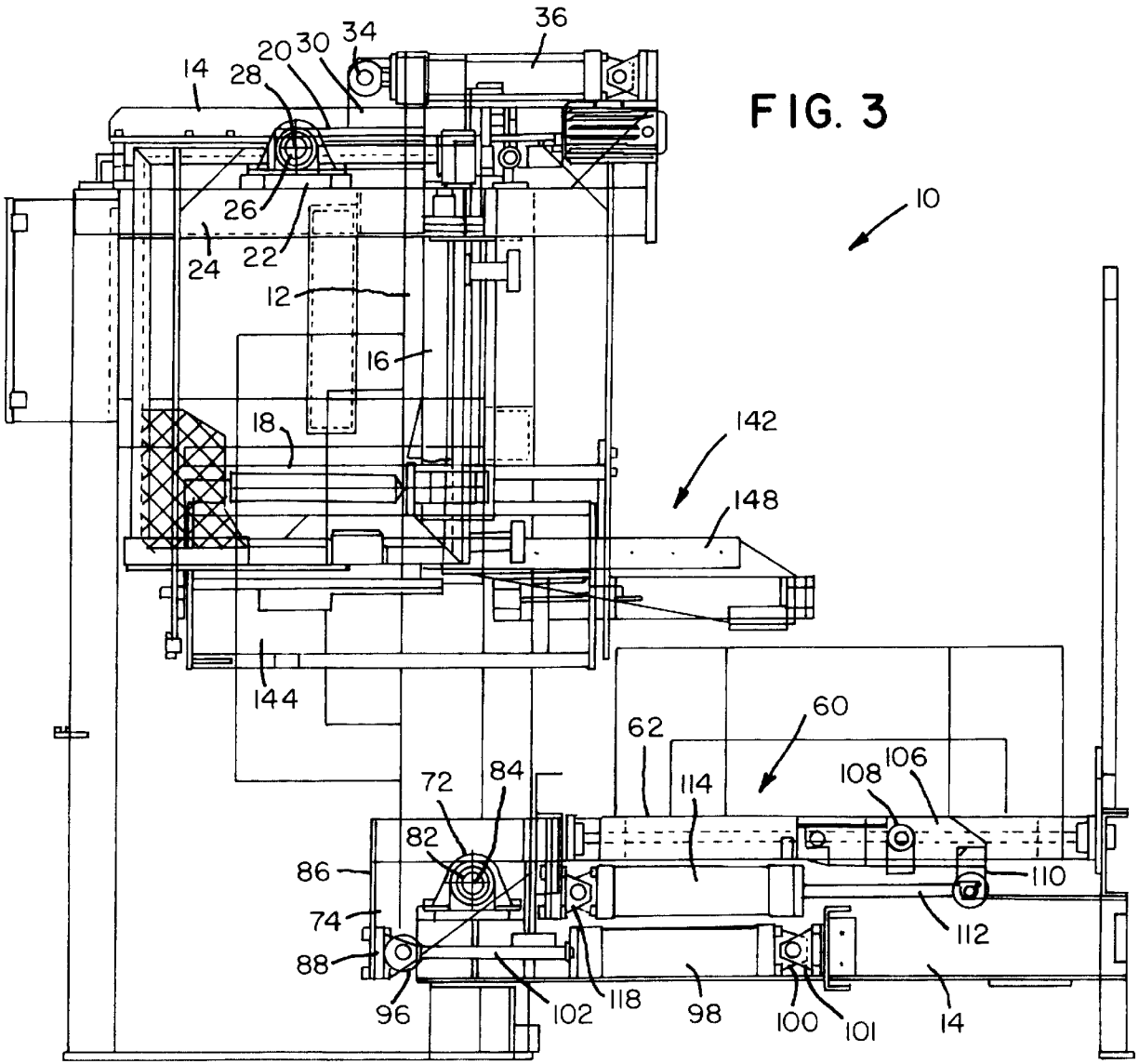
FIG. 3 is a side elevational view of the new and improved coil handling apparatus shown in FIGS. 1 and 2.

Referring now to the drawings, and more particularly to FIGS. 1–3 thereof, the new and improved coil handling apparatus, constructed in accordance with the principles and teachings of the present invention, is illustrated and generally indicated by the reference character 10, while the major individual components of the coil handling apparatus 10 are more specifically illustrated in detail in FIGS. 4–8. As an initial overview, which will of course be followed by a detailed description of the apparatus and the operation of the same, the apparatus of the present invention comprises a coil indexer assembly which initially supports a strap coil upon a pair of rotatable spindles. A strap binding head is then moved to an extended position at which the strap binding head and a binding strap chute assembly effectively surround a portion of the strap coil so as to place a tensioned binding strap upon the strap coil at a predetermined circumferential position of the strap coil.

After repeated circumferential indexing movements of the coil indexer assembly so as to position other predetermined circumferential portions of the strap coil at the binding strap station defined by the strap binding head, whereby additional binding straps are placed upon the strap coil such that the strap coil is now completely bound, the strap binding head is moved to its original retracted position, and an upender assembly is moved upwardly to a raised position at which a support arm of the upender assembly is moved to a position at which the support arm engages the bound strap coil and lifts the bound strap coil so as to effectively remove the bound strap coil from the rotatable spindles of the indexer assembly. The indexer assembly is then moved upwardly to a retracted inoperative position, whereupon the upender assembly is lowered so as to be returned to its original position as a result of which the bound strap coil is deposited upon a conveyor assembly. The upender support arm is returned to its original position whereupon the conveyor assembly is then able to convey the bound strap coil to a remote location for further routing or processing prior to commercial distribution of the strap coil. The indexer assembly is then lowered to its original operative position so as to be readied for a new strap coil to be bound.

With the foregoing description of the structural and operational overview now having been set forth, a detailed description of the coil handling apparatus 10, the major individual components thereof, and a detailed description of the operation of the same, will now be described with reference being made to the accompanying drawings. As seen in FIGS. 1–5, the coil indexer assembly, generally indicated by the reference character 12, is mounted upon a main framework 14, and it is further seen that the coil indexer assembly 12 comprises a pair of laterally spaced vertically extending masts or box beam members 16,16 upon the lower ends of which are respectively mounted a pair of forwardly projecting rotatable spindles 18,18. Near the upper ends of each one of the vertically extending masts or box beam members 16,16, there is respectively provided another pair of box beam members 20,20 which also project forwardly so as to be disposed substantially parallel to the rotatable spindles 18,18.

A pair of brackets 22,22 are adapted to be fixedly mounted upon laterally spaced box beam members 24,24 of the framework 14 as best seen in FIGS. 1–3, and as best seen in FIG. 2, and in accordance with a first embodiment of the invention, each one of the brackets 22,22 is respectively provided with a shaft or pintle 26,26 wherein the oppositely disposed distal end portions of the shafts or pintles 26,26 respectively extend or pass through the box beam members 20,20. In accordance with a second alternative embodiment of the invention, the shafts or pintles 26,26 may be provided upon the box beam members 20,20 so as to extend laterally outwardly therefrom in opposite directions and thereby respectively extend or pass through the brackets 22,22. In either case, the shafts or pintles 26,26 together define a rotary axis 28 about which the entire coil indexer assembly 12 is pivotally movable between a first lowered, operative position as shown in FIG. 1, and a second, raised inoperative position which will be described hereinafter.

A vertically disposed bracket plate 30 is affixed to the upper surface of each horizontally disposed box beam member 20 as well as to the upper end portion of each vertically disposed box beam member 16, and each bracket plate 30,30 is provided with an aperture 32 through which extends a bar or rod 34 to which one end of an actuating cylinder 36 is connected as best seen in FIG. 3, the other end of the cylinder 36 being affixed to the framework 14. In this manner, extension of the cylinder 36 from its position illustrated in FIG. 3 causes pivotal movement of the entire coil indexer assembly 12 in the counterclockwise direction about the pivotal axis 28 so as to move the coil indexer assembly 12 from its lowered operative position, shown for example in FIGS. 1 and 3, to its raised inoperative position as will be described hereinafter. Retraction of the cylinder 36 will of course pivotally move the coil indexer assembly 12 in the clockwise direction so as to return the coil indexer assembly 12 from its aforenoted raised, inoperative position back to its lowered, operative position so as to ready the coil indexer assembly 12 for a new coil handling operative cycle as will be described hereinafter in connection with FIGS. 9–16.

Figure 5:
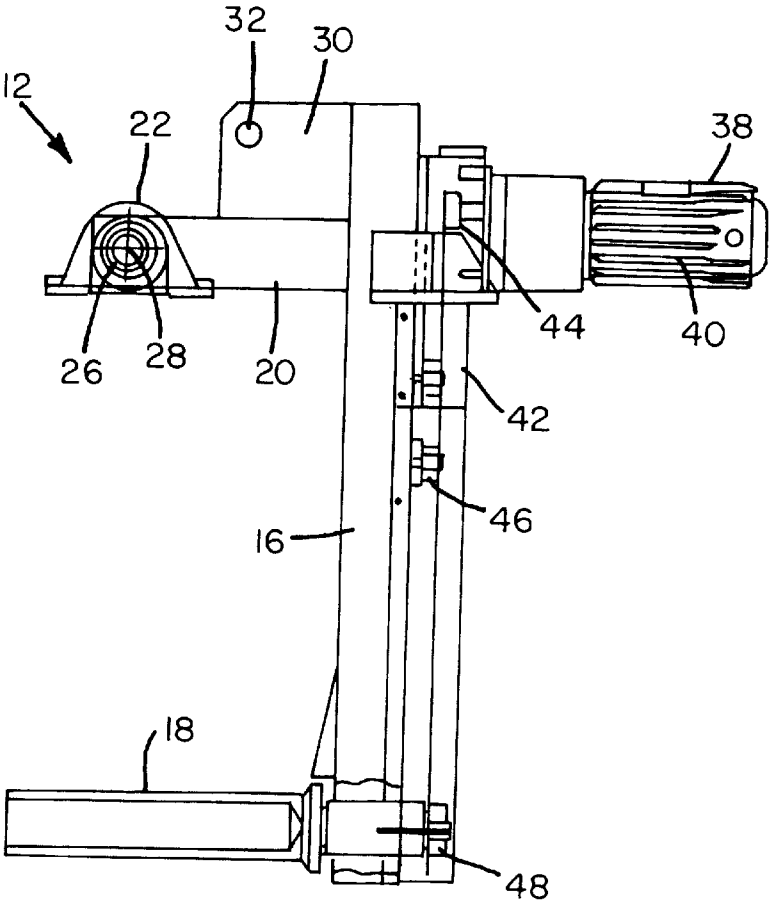
FIG. 5 is a side elevational view of the coil indexer assembly shown in FIG. 4.
Figure 4:
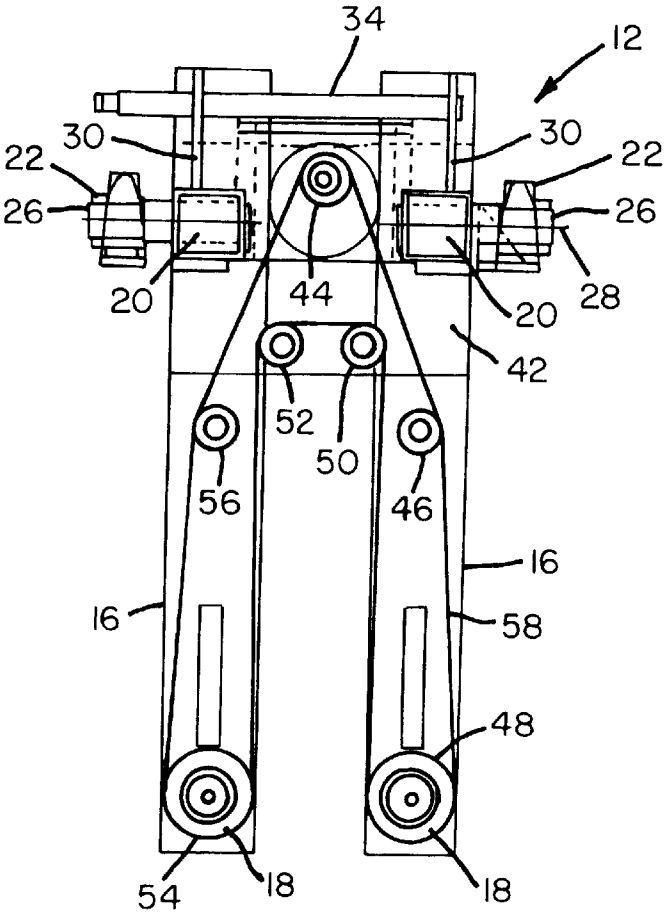
FIG. 4 is a front elevational view of a coil indexer assembly of the new and improved coil handling apparatus shown in FIGS. 1–3.

In order to provide rotatable drive to the rotatable spindles 18,18 such that the rotatable spindles can perform indexing operations upon the strap coils as will become apparent hereinafter, a rotary drive member 38, as best seen in FIG. 5, having a splined connection 40 formed upon the external surface portion thereof, is fixedly mounted upon an upper housing portion 42 which, in turn, is fixedly connected to the vertically extending box beam members 16, 16 of the coil indexer assembly 12. The rotary drive member 38 projects or extends rearwardly from the housing 42 so as to thereby be capable of being rotatably connected to a suitable motor drive mechanism, not shown.

The forward end of the rotary drive member 38 is provided with a first sprocket member 44 which is disposed within the housing 42, while a second sprocket member 46 is disposed internally within the upper end portion of a first one of the vertically extending box beam members 16,16. A third sprocket member 48 is likewise disposed internally within the lower end portion of the first one of the vertically extending box beam members 16,16 so as to be coaxially disposed with respect to, and mounted upon the rear end portion of, a first one of the rotatable spindles 18,18. Fourth and fifth laterally spaced sprocket members 50,52 are rotatably disposed within the lower central portion of the housing 42, and a sixth sprocket member 54 is disposed within the lower end portion of the second one of the vertically extending box beam members 16,16 so as to be coaxially disposed with respect to, and mounted upon the rear end portion of a second one of the rotary spindles 18,18. Lastly, a seventh sprocket member 56 is disposed internally within the upper end portion of a second one of the vertically extending box beam members 16,16. A drive chain 58 is routed about the sprocket members 44–56 so as to transmit rotary drive from the rotary drive member 38 to the rotary spindles 18, 18.

With reference now being made to FIGS. 2,3,6, and 7, the coil upender assembly is generally indicated by the reference character 60 and is seen to comprise an upender framework 62 which includes a pair of laterally spaced central frame members 64,66, and a pair of laterally spaced outer frame members 68,70. A pair of brackets 72,72, similar to brackets 22,22, are disposed laterally outwardly of the outer frame members 68,70 and are adapted to be fixedly attached to the apparatus framework 14. A plurality of bracket plates 74,76,78,80, comprising, in effect, extensions of the laterally spaced outer frame members 68,70 and the laterally spaced central frame members 64,66, are provided with suitable apertures so as to permit passage therethrough of a shaft or pintle 82 the opposite ends of which are disposed within the brackets 72,72. In this manner, the shaft or pintle 82 defines a rotary or pivot axis 84 about which the entire upender assembly 60 is rotated or pivoted with respect to the apparatus framework 14 as well as the indexer assembly 12 as will be more fully appreciated hereinafter. In order to provide for such pivotal movement of the upender assembly 60 with respect to the apparatus framework 14 and the indexer assembly 12, an end plate 86 fixedly interconnects the central frame members 64,66 and the outer frame members 68,70 as a result of being integrally connected to the bracket plates 74,76,78,80, and a pair of clevis members 88,90 are fixedly attached to the end plate 86. The clevis members 88,90 have apertures 92,94 respectively defined therein to which first ends 96 of a pair of actuating cylinders 98, only one of which is shown, for example, in FIG. 3, is attached by means of suitable bolt fasteners. Opposite second ends 100 of the actuating cylinders 98 are attached to the framework 14 by means of suitable clevis members 101, and each one of the actuating cylinders 98 further comprises an extensible/contractible piston rod 102 which is illustrated in its extended position in FIG. 3.

Consequently, it can be appreciated that when the piston rod 102 is contracted, the entire upender assembly 60 will rotate or pivot in the counterclockwise direction, as viewed in FIG. 3, around the pivot axis 84 so as to move the upender assembly 60 from its lowered position illustrated in FIG. 3 to a raised position which is substantially 90° with respect to the illustrated lowered position. Conversely, when the piston rod 102 is extended, the upender assembly 60 is rotated or pivoted in the clockwise direction as viewed in FIG. 3 so as to rotate or pivot the upender assembly 60 from its vertically disposed raised position to its horizontally disposed lowered position as illustrated in FIG. 3.

Figure 6:
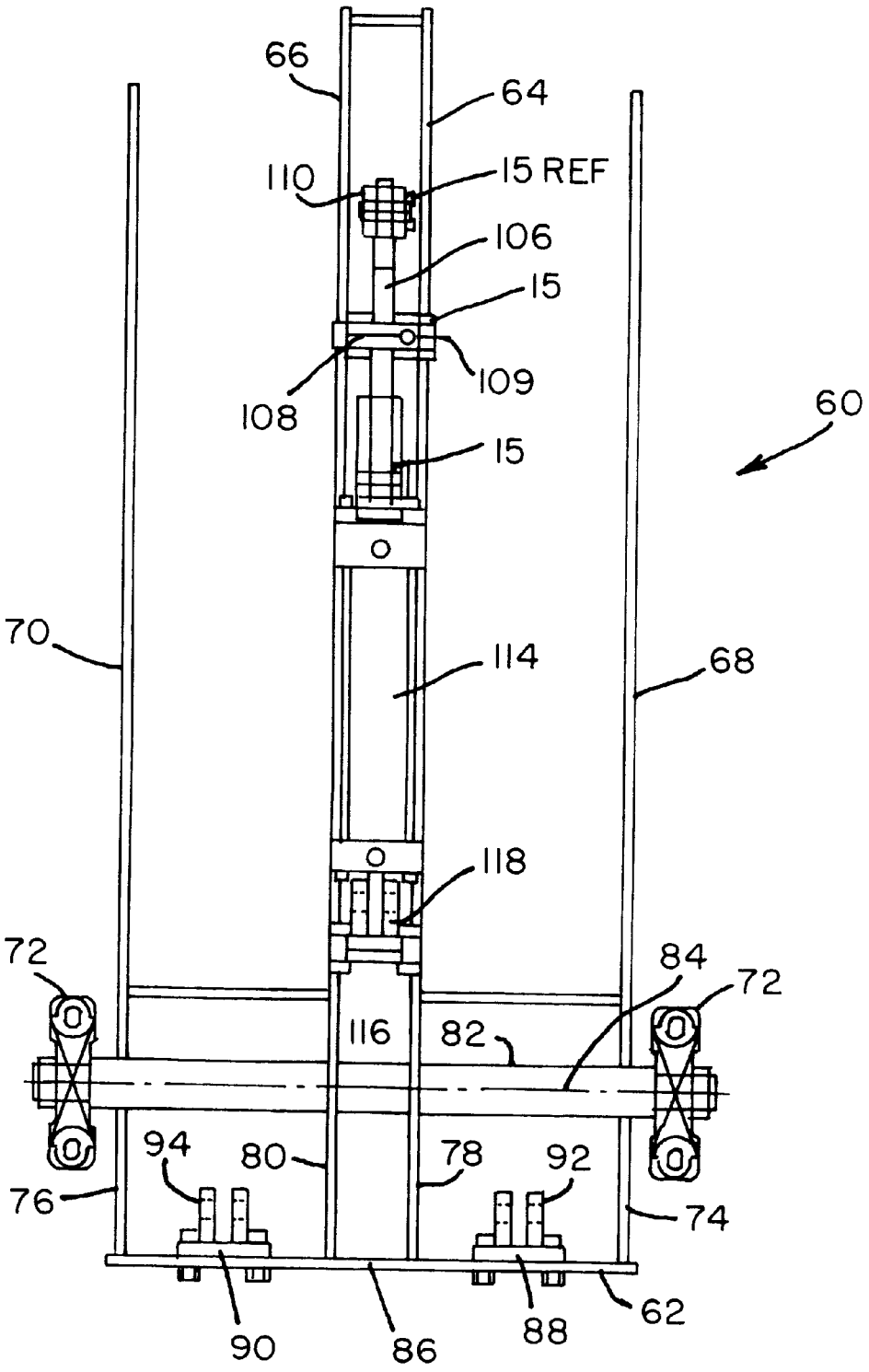
FIG. 6 is a top plan view of a coil upender assembly of the new and improved coil handling apparatus shown in FIGS. 1–3.

With continued reference being made to FIGS. 3, 6, and 7, and as will become more apparent hereinafter, when the upender assembly 60 is rotated or pivoted to its vertically disposed raised position, the upender assembly 60 will serve to engage a strap coil 104, disposed upon the rotatable spindles 18,18 of the indexer assembly 12, as seen in FIG. 1, and to subsequently elevate the strap coil 104 so as to effectively remove the strap coil 104 from the rotatable spindles 18,18. In order to achieve such an operation, the upender assembly 60 further comprises a support arm 106 which is pivotally mounted upon a bearing bracket and pintle assembly 108 which defines a pivot axis 109 and which is fixedly secured to and between the central frame members 64, 66. An actuating end of the support arm 106 has a bracket member 110 attached to a distal end of a piston rod 112 which is extensible and contractible with respect to its actuating cylinder 114, and the end of the actuating cylinder 114 which is disposed opposite the piston rod 112 is connected to a support bracket 116, secured between the central frame members 64,66, by means of a clevis member 118.

Consequently, when the piston rod 112 of the actuating cylinder 114 is contracted, support arm 106 will be pivoted around pivot axis 109 such that the support arm 106 will be disposed at a position which is 90° from the position illustrated in FIG. 3. In addition, when the upender assembly 60 is simultaneously pivoted to its vertically disposed raised position, then support arm 106 will be disposed substantially horizontally so as to engage the strap coil 104, elevate the strap coil 104 so as to effectively remove the strap coil 104 from the rotatable spindles 18,18, and support the strap coil 104 at the noted elevated position with respect to the rotatable spindles 18,18. When the piston rod 112 is extended, the support arm 106 is returned to its illustrated position at which the support arm 106 is interposed between the central frame members 64,66 for a purposed to be more fully explained and appreciated hereinafter.

Figure 8:
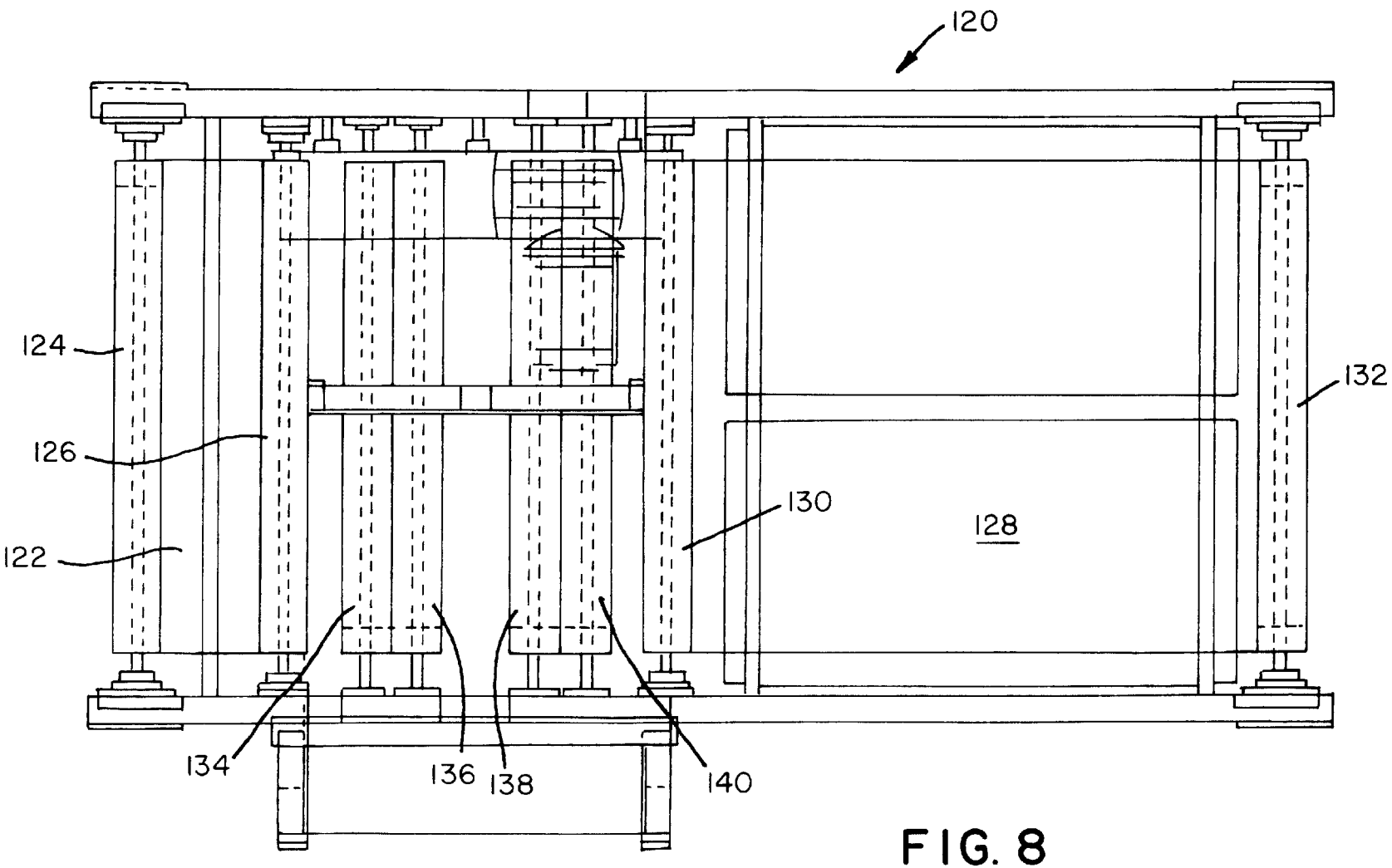
FIG. 8 is a top plan view of a coil discharge conveyor assembly of the new and improved coil handling apparatus shown in FIGS. 1–3.

With reference now being made to FIGS. 2 and 8, the discharge conveyor assembly is illustrated and is generally indicated by the reference character 120. More particularly, it is seen that the discharge conveyor assembly 120 comprises a first, relatively small belt conveyor 122 which is wrapped around a pair of drive rollers 124,126 which are driven by means of a suitable source of power, not shown, and a second, relatively large belt conveyor 128 which is likewise wrapped around a pair of drive rollers 130,132 which are similarly driven by means of a suitable source of power, also not shown.

Interposed between the first small and second large belt conveyors 122 and 128 is a set of roller conveyors 134,136, 138,140 wherein the roller conveyors 134 and 136 are disposed in a side-by-side array, while roller conveyors 138 and 140 are disposed in a similar side-by-side array. However, it is noted that roller conveyors 136 and 138 are laterally spaced from each other, while roller conveyor 134 is laterally spaced from drive roller 126, and similarly for roller conveyor 140 with respect to drive roller 130. In this manner, as is apparent from FIG. 2, when the upender assembly 60 is disposed in its horizontally disposed lowered position, central frame members 64 and 66 of the upender assembly 60 will be interposed between the roller conveyors 136 and 138, outer frame member 68 of the upender assembly 60 will be interposed between roller conveyor 140 and belt conveyor drive roller 130, and outer frame member 70 of the upender assembly 60 will be interposed between roller conveyor 134 and belt conveyor drive roller 126, all in an interdigitated manner.

With reference lastly being made to FIGS. 1–3 in connection with the detailed description of the structural components of the present invention coil handling apparatus, a strap binding head assembly is generally indicated by the reference character 142 and is seen to comprise a strap binding head 144 and a binding strap conveyor or routing chute which comprises a first stationary chute section 146 fixedly mounted upon the strap binding head 144, and a second movable chute section 148 which is movably mounted upon the strap binding head 144 so as to be movable between a first opened position as clearly illustrated in FIG. 2, and a second closed position, not illustrated, at which a free end portion 150 of movable chute section 148 is disposed adjacent to a free end portion 152 of stationary chute section 146 such that stationary chute section 146, movable chute section 148, and binding strap head 144 together define in effect a closed loop track mechanism through which a binding strap is disposed so as to encircle a portion of the strap coil 104 when binding straps are to be secured upon the strap coil 104 at predetermined circumferential positions thereof. It is of course to be appreciated that movable chute section 148 is movable between its opened and closed positions by suitable automatically controlled, motorized means, not shown, whereby the movable chute section 148 is operated at predetermined times during the operative strap binding cycle as will be described hereinafter. It is lastly appreciated that the entire strap binding head assembly 142 is dependently supported from a suitable carriage assembly which is generally indicated by the reference character 154 wherein the carriage assembly 154 is movable along an upper rail or track portion 156 of the main framework 14 by means of a suitable motorized drive system, not described in detail as such detail of the carriage assembly 154 is deemed unnecessary to the disclosure and understanding of the present invention whereby such details are omitted herefrom.

Having now described the pertinent structural details of the various structural components comprising the overall coil handling apparatus, equipment, or system 10 of the present invention, a brief description of the operation of such apparatus, equipment, or system 10 of the present invention, that is, a complete operative cycle of the apparatus, equipment, or system 10, will now be described with reference being made to FIGS. 9–16.

Figure 9:
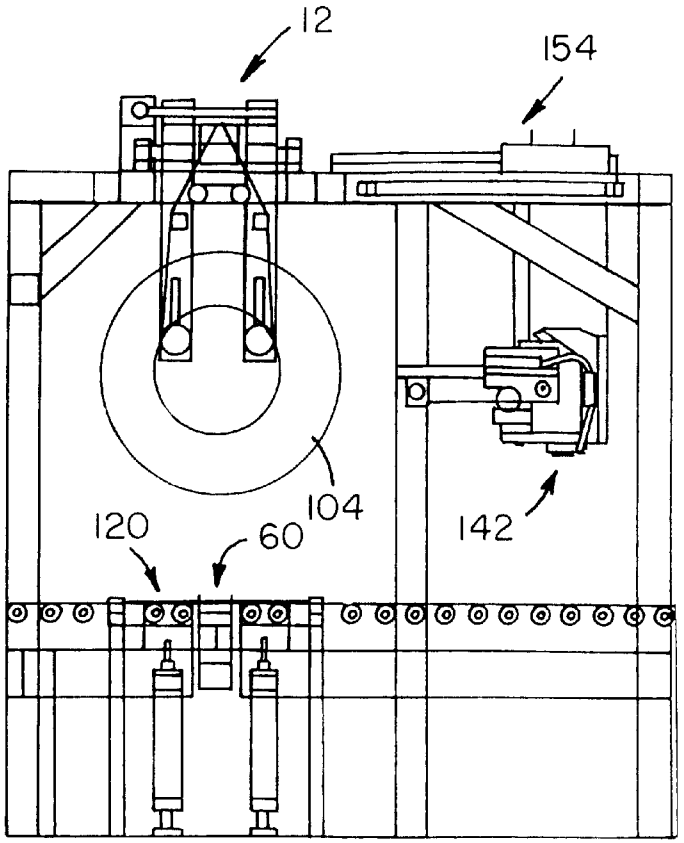
FIG. 9 is a front elevational view, similar to that of FIG. 1, schematically illustrating a first major step of the coil handling operation wherein the strap coil is deposited upon the coil indexer assembly.

Commencing with the apparatus or system illustrated in FIG. 9, it is to be appreciated that actuating cylinder 36 has been contracted such that the indexer assembly 12 has been moved to, or is disposed at, its pivotally lowered operative position at which the rotatable spindles 18, 18 are disposed horizontally and project outwardly from the page of the drawings so as to in fact be capable of supporting a strap coil thereon, and that a strap coil 104 has been deposited upon rotatable spindles 18,18 in preparation for a strap binding operation, the spindles 18,18 not being rotatably energized at this time. At this point in time, it is also noted that the strap binding head assembly 142, through means of its carriage assembly 154, is disposed at a remote or retracted position with respect to the strap coil 104 disposed upon the rotatable spindles 18,18 of the indexer assembly 12, and that the upender assembly 60 is disposed in its pivotally lowered position so as to be disposed in its interdigitated mode with respect to the discharge conveyor assembly 120. The strap coil 104 is therefore now ready to have binding straps placed thereon.

Figure 10:
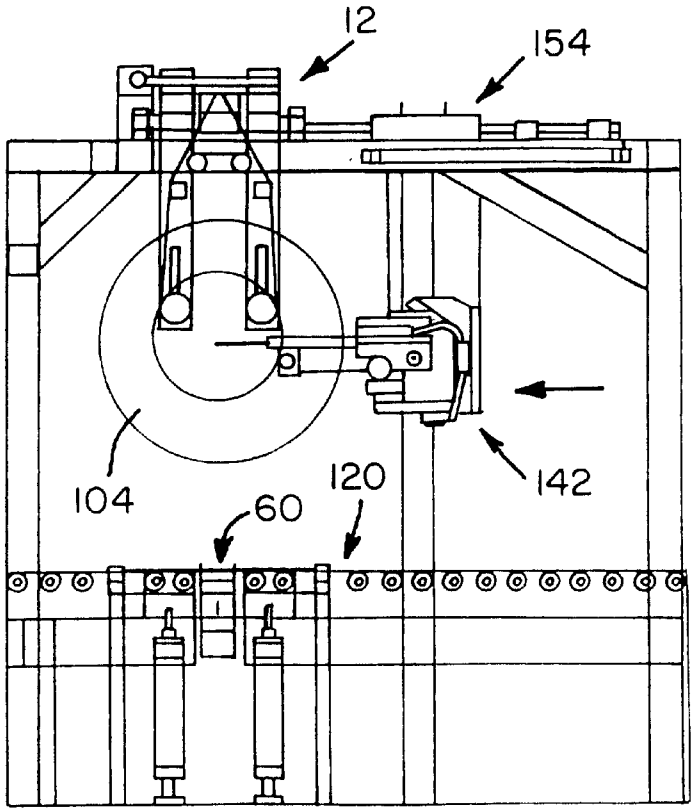
FIG. 10 is a view similar to that of FIG. 9 schematically illustrating a second major step of the coil handling operation wherein the binding strap head has been moved from its retracted inoperative position to its extended operative position at which the binding strap head secures a binding strap around the strap coil supported upon the coil indexer assembly.

Accordingly, as now seen and appreciated from FIG. 10, the carriage assembly 154 is energized, and accordingly, the strap binding head assembly 142 is moved from its remote or retracted position with respect to the strap coil 104 to a position adjacent to the strap coil 104 whereupon, since the movable chute section 148 is initially disposed at its opened position with respect to the stationary chute section 146, the strap binding head assembly 142 can in effect encircle a particular portion of the strap coil 104. Upon closure of the movable chute section 148 with respect to the stationary chute section 146, the strap binding head assembly 142 in fact completely encircles the illustrated portion of the strap coil 104 whereby a binding strap can be routed through the entire strap binding head assembly 142 and applied to the strap coil 104. More particularly, after the binding strap has been routed through the chute components or sections 146,148, the strap binding head 144 is appropriately energized whereby the binding strap is initially tensioned to a predetermined degree about strap coil 104, end portions of the tensioned binding strap are then welded together, and the binding strap is then severed thereby completing a first strap binding operation.

At this point in time, since it is desired to place a plurality of binding straps upon the strap coil 104 at predetermined circumferential locations of the strap coil 104, such as, for example, at angular positions spaced 90° apart or 60° apart whereby, respectively, four or six binding straps will be placed upon the strap coil 104, the strap binding head 144 is appropriately energized such that the tension within the strap binding head 144 with respect to the binding strap and the strap coil 104 is reduced so as to permit the strap coil 104 to be rotated a predetermined angular amount such that additional binding straps can be applied to the strap coil 104 at predetermined circumferential positions thereof. Accordingly, the chain drive system 58 of the indexer assembly 12 is energized whereby the spindles 18,18 are now rotated so as to in turn cause rotation of the strap coil 104, which is of course supported upon the spindles 18,18 by means of the inner peripheral surface of its core upon which the coiled strapping material is disposed, so as to in fact index the strap coil 104 to a new circumferential position with respect to the strap binding head 144. At each circumferential location at which it is desired to place a binding strap upon the strap coil 104, the chain drive system 58 of the indexer assembly 12 is therefore stopped, and the strap binding head 144 is again energized so as to develop the proper tension with the binding strap, after which the new end portions of the binding strap are welded together and the ends of the binding strap are severed so as to again complete a subsequent strap binding operation upon the strap coil 104.

Figure 11:
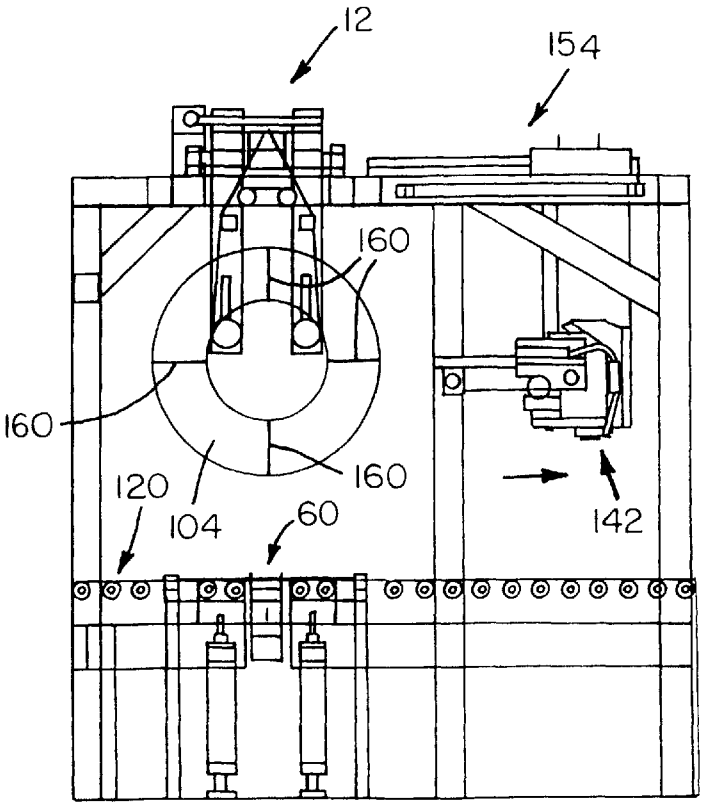
FIG. 11 is a view similar to that of FIG. 10 schematically illustrating a third major step of the coil handling operation wherein the binding strap head has been moved from its extended operative position back to its retracted inoperative position in preparation for removal of the bound strap coil from the coil indexer assembly.

When the desired number of binding straps have been applied to the strap coil 104, such as, for example, when four binding straps 160 have been applied to particular circumferential locations of the strap coil 104 angularly separated 90° apart, as illustrated in FIG. 11, the movable chute section 148 of the strap binding head assembly 142 is moved from its closed position, with respect to the stationary chute section 146 of the strap binding head assembly 142, to its opened position with respect to the stationary chute section 146 of the strap binding head assembly 142, whereby the carriage assembly 154 is then energized so as to move the strap binding head assembly 142 back to its retracted position remote from the strap coil 104. The bound strap coil 104 is now ready to be removed from the spindles 18,18 of the indexer assembly 12 so as to be routed or processed further for commercial distribution.

Figure 12:
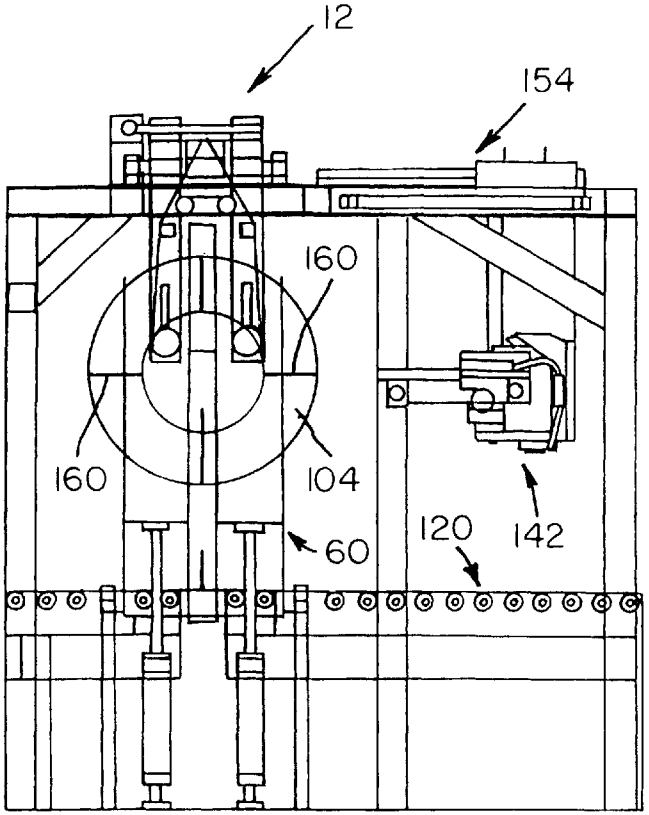
FIG. 12 is a view similar to that of FIG. 11 schematically illustrating a fourth major step of the coil handling operation wherein the coil upender assembly has been moved from its lowered position to its elevated position at which the coil upender assembly is readied to engage the bound strap coil so as to remove the bound strap coil from the coil indexer assembly and to support the bound strap coil so as to permit the coil indexer assembly to be moved to its elevated inoperative position.
Figure 13:
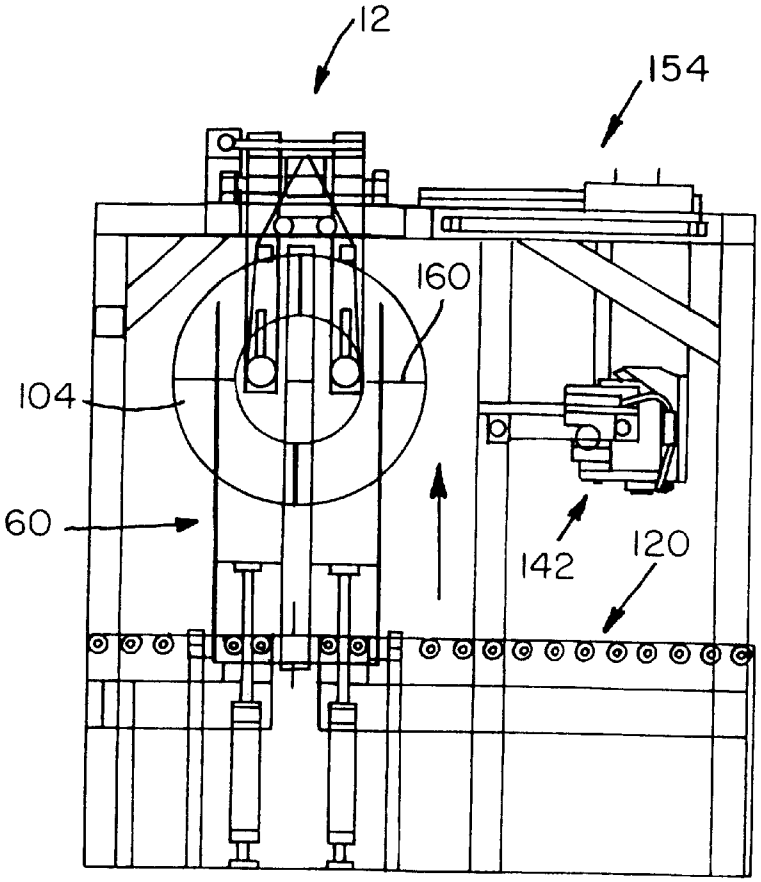
FIG. 13 is a view similar to that of FIG. 12 schematically illustrating a fifth major step of the coil handling operation wherein the coil upender assembly has engaged the bound strap coil and has removed the bound strap coil from the coil indexer assembly so as to permit the coil indexer assembly to be subsequently moved to its elevated inoperative position.

Accordingly, with reference now being made to FIG. 12, the actuating cylinders 98 have been energized such that the upender assembly 60 has now been rotated or pivoted from its lowered, horizontally disposed interdigitated position with respect to the discharge conveyor assembly 120 to its raised vertically disposed position at which the upender framework 64–70 is disposed behind the strap coil 104. At this point in time, the strap coil 104 is still supported upon the forwardly projecting or extending spindles 18,18 of the indexer assembly 12 as can be seen from FIG. 12 wherein the upper inner peripheral portion of the strap coil core is shown disposed upon the spindles 18,18. With additional reference now being made to FIG. 13, the actuating cylinder 114 has been energized whereby the support arm 106 has now been pivoted from its position shown in FIG. 3, with respect to the upender framework 62, to a position 90° with respect thereto. The free end of the support arm 106, that is, the end not connected to the actuating cylinder 114, is accordingly moved between the depending box beam members 16, 16 and as the support arm 106 is pivoted to its full pivoted position 90° from the position shown in FIG. 3, the support arm 106 engages the inner peripheral surface of the strap coil core and elevates the same so as to effectively remove the strap coil 104 from the spindles 18,18 as shown in FIG. 13. The spindles 18,18 therefore no longer support the strap coil 104.

Figure 14:
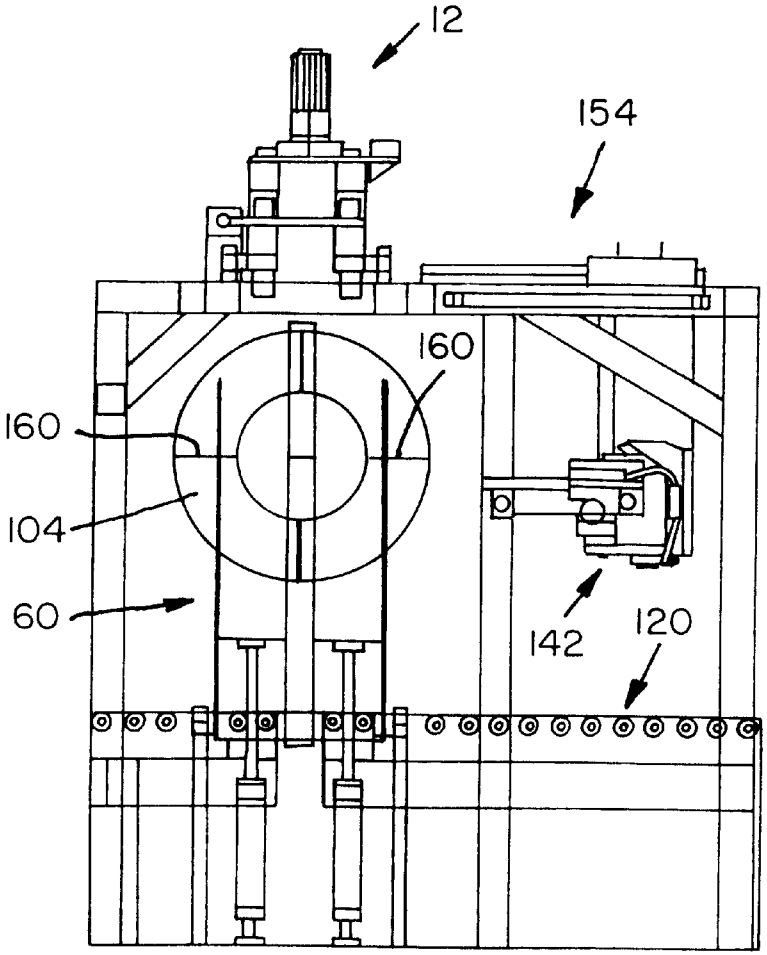
FIG. 14 is a view similar to that of FIG. 13 schematically illustrating a sixth major step of the coil handling operation wherein the coil upender assembly is shown supporting the bound strap coil and the coil indexer assembly has been moved upwardly to its inoperative position.

Accordingly, with the strap coil 104 effectively removed from the indexer assembly spindles 18,18, the indexer assembly 12 can now be removed from the vicinity of the strap coil 104 in preparation for discharge of the bound strap coil 104 from the apparatus 10. With reference therefore being made to FIG. 14, it is seen that as a result of the energization of actuating cylinder 36, the indexer assembly 12 has been pivotally moved from its lowered position, at which it was used to support a strap coil 104, to a raised position at which it is entirely disengaged from the strap coil 104 and, more importantly, it clears the region within which the bound strap coil 104 is now disposed in a supported disposition upon the raised upender assembly 60. More particularly, as can be appreciated if reference is again made to FIGS. 12 and 13, when the upender assembly 60 is moved to its raised position, the dependent box beam members 16,16 of the indexer assembly 12, as well as the spindles 18,18 disposed upon the box beam members 16,16, are interposed between frame members 66 and 70, and between 64 and 68, respectively, in an interdigitated manner. Accordingly, when the indexer assembly 12 is pivoted to its raised position, the box beam members 16,16, and the spindles 18,18 disposed thereon, are able to move between the noted frame members 64,68 and 66,70 of the upender assembly 60 so as to attain their retracted positions as disclosed in FIG. 14.

Figure 15:
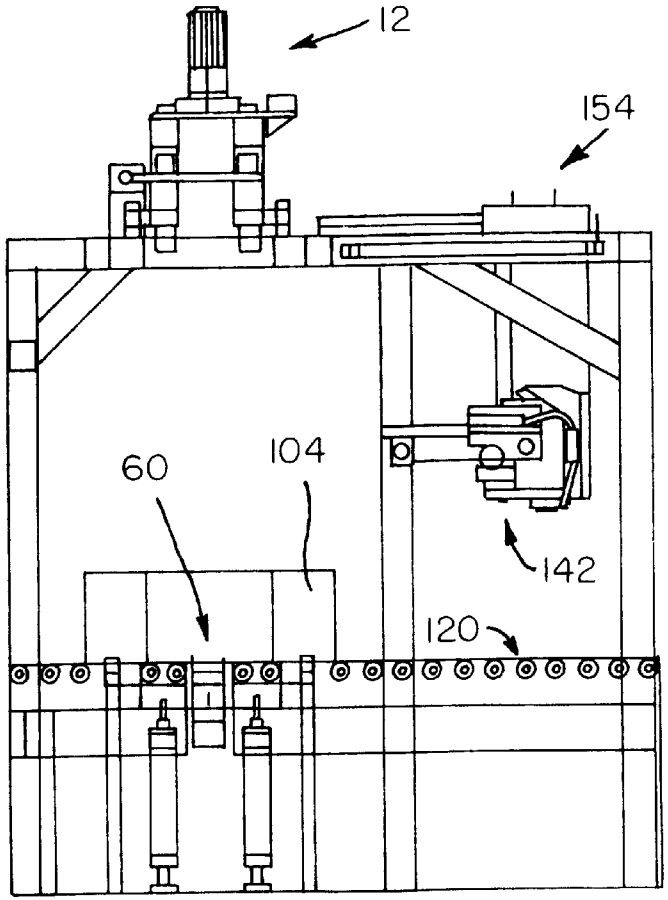
FIG. 15 is a view similar to that of FIG. 14 schematically illustrating a seventh major step of the coil handling operation wherein the coil upender assembly has been moved downwardly to its lowered position at which the coil upender assembly places the bound strap coil upon the discharge conveyor assembly.

As a result of the aforenoted clearance or removal of the indexer assembly 12 from the region within which the bound strap coil 104 is now supported upon the upender assembly 60, the latter is now able to be pivoted downwardly, while still supporting the bound strap coil 104 thereon, so as to return to its original horizontal state as shown in FIG. 15. At this position of the upender assembly 60, the frame members 64–70 will be disposed in the aforenoted interdigitated manner with respect to the conveyor assembly 120 whereupon the upper surface of the upender assembly framework 62, as viewed in FIG. 15, will be substantially coplanar with, or disposed just slightly beneath, the upper surface of the conveyor assembly 120 such that the bound strap coil 104 is able to be placed upon the upper surface of the conveyor assembly 120. The bound strap coil 104 is therefore essentially ready to be conveyed by the conveyor assembly 120 to a remote location for further routing or processing prior to commercial distribution.

Figure 7:
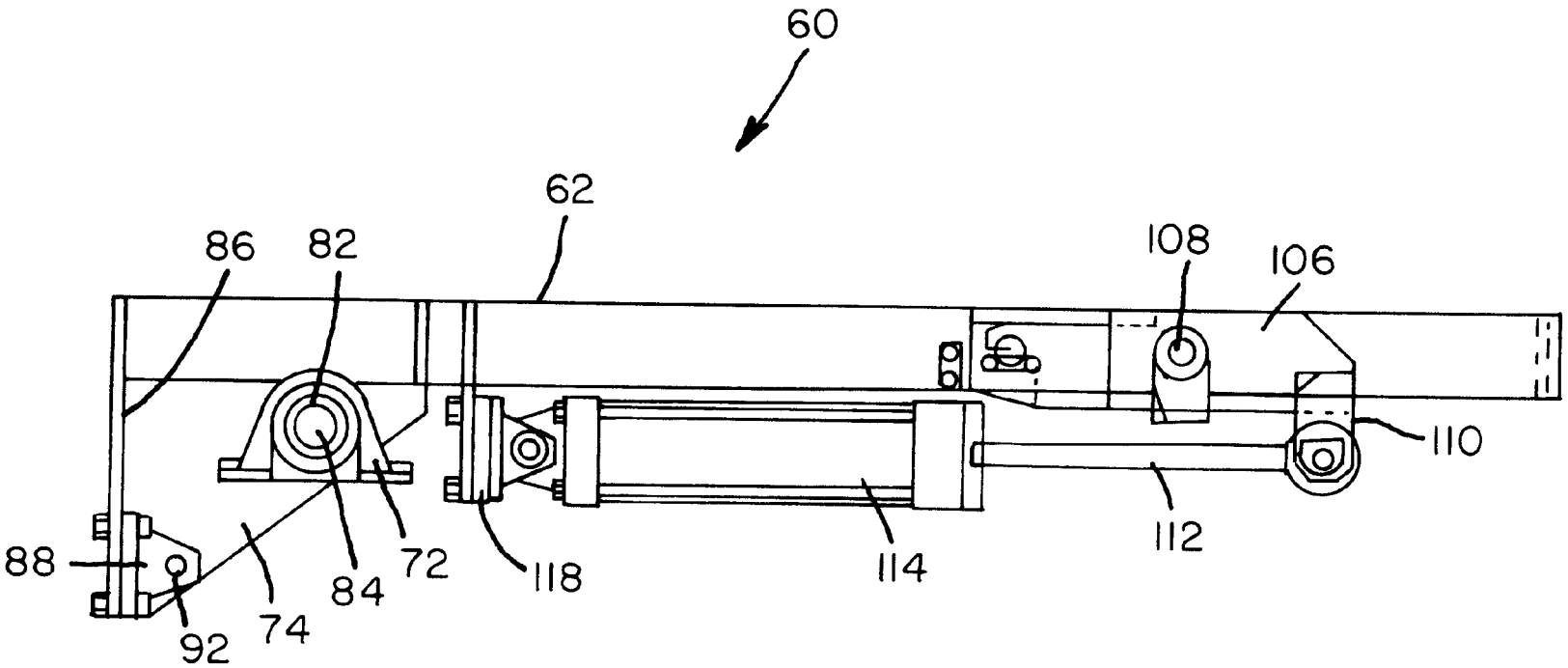
FIG. 7 is a side elevational view of the coil upender assembly shown in FIG. 6 when the coil upender assembly is disposed in its downward position and when the coil support arm thereof is disposed in its retracted position.
Figure 16:
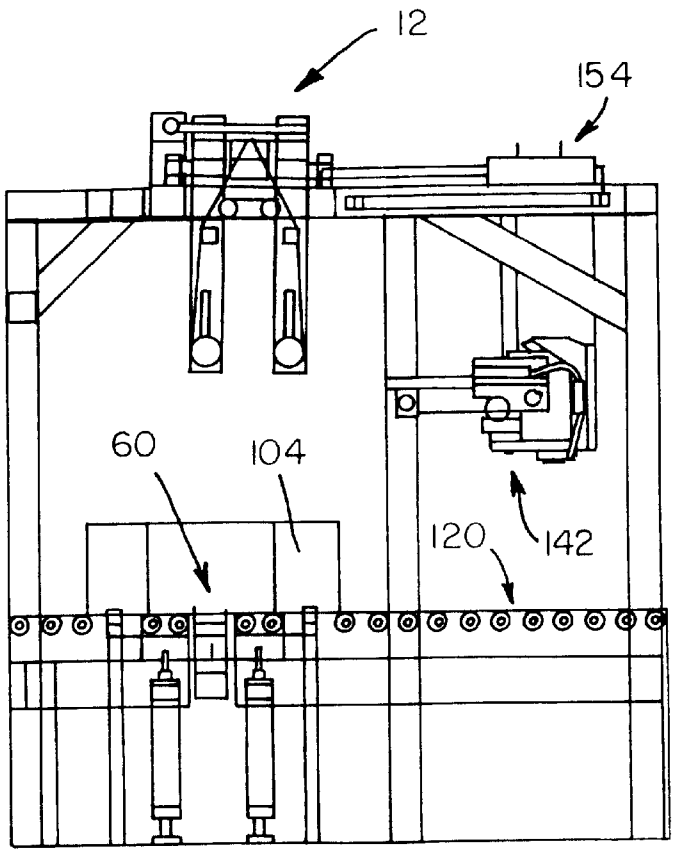
FIG. 16 is a view similar to that of FIG. 15 schematically illustrating an eighth major step of the coil handling operation wherein the coil support arm of the coil upender assembly has been returned to its retracted position so as to permit the discharge conveyor assembly to convey the bound strap coil to a remote location for further routing and processing prior to commercial distribution, and the coil indexer assembly has been lowered and returned to its operative position in preparation for receiving a new strap coil to be bound.

Prior to such conveyance of the bound strap coil 104 by the conveyor assembly 120, the actuating cylinder 114 of the upender assembly 60 is again energized so as to return the support arm 106 to its position shown in FIGS. 3 and 7 whereby the support arm 106 is no longer needed to support the strap coil 104 in view of the support of the strap coil 104 upon the conveyor assembly 120. In addition, the return of the support arm 106 to its position shown in FIGS. 3 and 7 renders the support arm 106 substantially coplanar with the framework 62 of the upender assembly 60 so as not to interfere with the conveyed movement of the bound strap coil 104 along the conveyor assembly 120. Still further, substantially simultaneously with the return of the support arm 106 to its lowered or retracted position, and the subsequent energization of the conveyor assembly 120 so as to discharge the bound strap coil 104, the actuating cylinder 36 of the indexer assembly 12 is again energized so as to pivotally return the indexer assembly 12 to its lowered position as illustrated in FIG. 16 whereby it can be appreciated that the entire strap coil handling operation has completed an entire operational cycle and the indexer assembly spindles 18,18 are again readied to receive a new strap coil to be bound. The strap coil is preferably supported and moved onto the spindles 18,18 of the indexer assembly 12 by means of a suitable, operator-controlled overhead crane implement which is not shown and does not constitute part of the present invention.

Thus, it may be seen that in accordance with the principles and teachings of the present invention, new and improved coil handling apparatus or equipment has been developed whereby all of the strap coil handling operations are automated. Accordingly, the strap binding operation is not nearly as labor-intensive as current strap coil binding operational systems, and the tedium and fatigue impressed upon the operator personnel have been essentially eliminated or at least drastically reduced.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A coil handling system for handling coiled material disposed upon a core, comprising:

an indexer assembly for initially supporting a coil of material to be bound and for rotating the coil of material between at least two circumferentially spaced indexed positions at which at least two binding straps are to be placed upon the coil of material so as to prevent the coil of material from uncoiling;

a strap binding assembly for placing a binding strap upon the coil of material at least two positions of the coil of material while the coil of material is disposed upon said indexer assembly so as to bind the coil of material at said at least two indexed positions whereby the bound coil of material is prevented from uncoiling;

a conveyor assembly for conveying the bound coil of material to a location remote from said indexer assembly; and an upender assembly for removing the bound coil of material from said indexer assembly so as to support the bound coil of material, and for transferring the bound coil of material onto said conveyor assembly.

2. A coil handling system as set forth in claim 1, wherein said indexer assembly comprises:

a pair of rotatable spindles upon which the coil of material is initially supported; and a drive system for rotating said rotatable spindles a predetermined amount so as to index the coil of material a predetermined angular amount from a first one of said at least two indexed positions to a second one of said at least two indexed positions.

3. A coil handling system as set forth in claim 2, wherein:

said drive system comprises a plurality of sprocket members and a sprocket drive chain.

4. A coil handling system as set forth in claim 2, further comprising:

a frame member; and wherein said upender assembly is pivotally mounted upon said frame member between a first elevated position at which said upender assembly engages the bound coil of material so as to remove the bound coil of material from said indexer assembly, and a second lowered position at which said upender assembly deposits the bound coil of material upon said conveyor assembly.

5. A coil handling system as set forth in claim 4, wherein:

said rotatable spindles of said indexer assembly are laterally spaced from each other; and said upender assembly comprises a support arm which is interposed between said laterally spaced rotatable spindles of said indexer assembly when said upender assembly is disposed at said first elevated position so as to engage the bound coil of material and transfer the bound coil of material from said rotatable spindles of said indexer assembly to said support arm of said upender assembly.

6. A coil handling system as set forth in claim 5, wherein:

said support arm of said upender assembly is pivotally mounted upon said upender assembly so as to be movable between a first position at which said support arm can engage the bound coil of material, remove the bound coil of material from said rotatable spindles of said indexer assembly, and support the bound coil of material, when said upender assembly is disposed at said first elevated position, and a second position at which said support arm is disposed in a substantially coplanar manner with respect to said conveyor assembly when said upender assembly is disposed at said second lowered position so as to permit said conveyor assembly to convey the bound coil of material to the location remote from said indexer assembly.

7. A coil handling system as set forth in claim 4, wherein:

said conveyor assembly comprises a plurality of roller conveyors; and said upender assembly comprises a framework comprising a plurality of frame members which are interposed between said plurality of roller conveyors in an interdigitated manner when said upender assembly is disposed in said second lowered position.

8. A coil handling system as set forth in claim 4, wherein:

said indexer assembly is pivotally mounted upon said frame member between a first lowered operative position at which said rotatable spindles can support the coil of material, and a second raised inoperative position at which said indexer assembly is disposed away from said upender assembly when said upender assembly is disposed at said first elevated position so as to permit said upender assembly to move to said second lowered position with respect to said conveyor assembly.

9. A coil handling system as set forth in claim 1, wherein said strap binding assembly comprises:

a strap binding head; and a strap binding conveyor chute which cooperates with said strap binding head so as to effectively define a closed-loop strap binding assembly which encircles a predetermined circumferential portion of the coil of material at which a binding strap is to be placed upon the coil of material.

10. A coil handling assembly as set forth in claim 9, wherein:

said strap binding conveyor chute comprises a first conveyor section fixedly disposed with respect to said strap binding head, and a second conveyor section movably mounted with respect to said first conveyor section between a first opened position so as to permit the predetermined circumferential portion of the coil of material to be moved relative to said strap binding assembly whereby the predetermined circumferential portion of the coil of material can be disposed interiorly of said closed-loop strap binding assembly, and a second closed position so as to define said closed-loop strap binding assembly which encircles the predetermined circumferential portion of the coil of material.

11. A coil handling assembly as set forth in claim 1, further comprising:

a framework; and a carriage assembly movably mounted upon said framework for dependently supporting said strap binding assembly.

12. A method of handling coiled material disposed upon a core, comprising the steps of:

placing a coil of material, to be bound by binding straps, upon an indexer assembly which initially supports the coil of material at a predetermined circumferential position while at least two binding straps are placed upon the coil of material at least two circumferentially spaced positions of the coil of material so as to prevent the coil of material from uncoiling;

moving a strap binding assembly toward the coil of material disposed upon said indexer assembly and activating said strap binding assembly such that said strap binding assembly operatively engages the coil of material at a first one of the at least two circumferentially spaced positions of the coil of material and places a first one of the at least two binding straps upon the coil of material at the first one of the at least two circumferentially spaced positions of the coil of material while the coil of material is disposed upon said indexer assembly;

deactivating said strap binding assembly after the first one of the at least two binding straps has been placed upon the coil of material at the first one of the at least two circumferentially spaced locations so as to permit the coil of material to be indexed by said indexer assembly to a second one of the at least two circumferentially spaced positions;

activating said indexer assembly so as to index the coil of material to at least a second one of the at least two circumferentially spaced positions at which at least a second one of the at least two binding straps is to be placed upon the coil of material;

re-activating said strap binding assembly such that said strap binding assembly operatively engages the coil of material at the at least second one of the at least two circumferentially spaced positions of the coil of material and places at least a second one of the at least two binding straps upon the coil of material at the at least second one of the at least two circumferentially spaced positions of the coil of material while the coil of material is disposed upon said indexer assembly;

moving said strap binding assembly away from said indexer assembly;

moving an upender assembly to a first position at which said upender assembly removes the bound coil of material from said indexer assembly so as to support the bound coil of material upon said upender assembly;

moving said indexer assembly away from said upender assembly upon which the bound coil of material is supported; and moving said upender assembly to a second position so as to transfer the bound coil of material onto a conveyor assembly for conveying the bound coil of material to a remote location.

13. The method as set forth in claim 12, wherein:

said indexer assembly and said strap binding assembly are successively activated such that four binding straps are placed upon the coil of material at 90° circumferentially spaced locations of the coil of material.

14. The method as set forth in claim 12, wherein:

said indexer assembly and said strap binding assembly are successively activated such that six binding straps are placed upon the coil of material at 60° circumferentially spaced locations of the coil of material.

15. The method as set forth in claim 12, wherein:

said indexer assembly comprises a pair of laterally spaced rotatable spindles;

said placing of the coil of material upon said indexer assembly comprises placing the coil of material upon said laterally spaced rotatable spindles such that the core of the coil of material is supported upon said rotatable spindles; and said activating said indexer assembly so as to index the coil of material to at least a second one of the at least two circumferentially spaced positions comprises rotating said rotatable spindles such that the core of the coil of material is rotated by said rotatable spindles.

16. The method as set forth in claim 15, wherein:

said upender assembly comprises a framework within which is mounted a support arm;

said moving of said upender assembly to said first position comprises moving said upender assembly framework from said second position, at which said upender assembly framework is disposed in a substantially horizontal orientation, to said first position at which said upender assembly is disposed in a substantially vertical orientation; and said removal of the bound coil of material from said indexer assembly onto said upender assembly comprises moving said support arm from a substantially vertical orientation, when said upender framework is disposed at said first position and in said substantially vertical orientation, to a substantially horizontal orientation.

17. The method as set forth in claim 16, wherein:

when said support arm is moved from said substantially vertical orientation to said substantially horizontal orientation, said support arm is interposed between said rotatable spindles in a substantially interdigitated manner.

18. The method as set forth in claim 15, wherein:

said indexer assembly is disposed at a lowered position at which said rotatable spindles are disposed substantially horizontally so as to initially support the coil of material; and said indexer assembly is disposed at an elevated position at which said rotatable spindles are disposed substantially vertically when said indexer assembly is moved away from said upender assembly.

19. The method as set forth in claim 12, wherein:

said upender assembly comprises a framework within which is mounted a support arm;

said moving of said upender assembly to said first position comprises moving said upender assembly framework from said second position, at which said upender assembly framework is disposed in a substantially horizontal orientation, to said first position at which said upender assembly is disposed in a substantially vertical orientation; and said removal of the bound coil of material from said indexer assembly onto said upender assembly comprises moving said support arm from a substantially vertical orientation, when said upender framework is disposed at said first position and in said substantially vertical orientation, to a substantially horizontal orientation.

20. The method as set forth in claim 12, wherein:

said conveyor assembly comprises a plurality of roller conveyors;

said upender assembly comprises a framework; and when said upender assembly is moved to said second position, said framework of said upender assembly is disposed in a substantially coplanar interdigitated manner with respect to said plurality of roller conveyors of said conveyor assembly.

* * * * *